United States Patent [19]

Drellishak

[11] 4,269,156

[45] May 26, 1981

[54] AIR/FUEL RATIO MANAGEMENT SYSTEM WITH CALIBRATION CORRECTION FOR MANIFOLD PRESSURE DIFFERENTIALS

[75] Inventor: Glen J. Drellishak, Rochester, Mich.

[73] Assignee: The Bendix Corporation, Southfield, Mich.

[21] Appl. No.: 35,036

[22] Filed: May 1, 1979

[51] Int. Cl.[3] ..... F02B 3/00

[52] U.S. Cl. ..... 123/478; 123/445; 123/440

[58] Field of Search ..... 123/32 EE, 32 EA, 119 EC, 123/32 AE, 32 EJ, 97 B, 119 A, 32 ED

[56] References Cited

U.S. PATENT DOCUMENTS

| | | | |
|---|---|---|---|
| 3,581,723 | 6/1971 | Scholl | 123/140 MP |
| 3,834,366 | 9/1974 | Kingsbury | 123/119 A |
| 3,946,714 | 3/1976 | Eckert et al. | 123/139 AW |
| 3,949,713 | 4/1976 | Rivere | 123/32 EA |
| 3,949,714 | 4/1976 | Mitchell | 123/32 EA |
| 4,031,871 | 6/1977 | Hamanishi | 123/119 A |
| 4,114,575 | 9/1978 | Nohira et al. | 123/97 B |
| 4,125,100 | 11/1978 | Assenheimer et al. | 123/119 EC |
| 4,138,979 | 2/1979 | Taplin | 123/32 EE |
| 4,165,650 | 8/1979 | Weissler | 123/32 EA |
| 4,168,679 | 9/1979 | Ikeura et al. | 123/32 ED |

*Primary Examiner*—Charles J. Myhre
*Assistant Examiner*—R. A. Nelli
*Attorney, Agent, or Firm*—William A. Marvin; Russel C. Wells

[57] ABSTRACT

An air fuel ratio management system having a calibration correction for the pressure differentials between the exhaust and intake manifolds of the engine is disclosed. The differential calibration corrects the air/fuel ratio of the system for the variable internal exhaust gas recirculation occasioned by changing restrictions to flow found in the intake and exhaust manifolds. In one implementation a differential pressure sensor communicates with both the intake and exhaust manifolds to develop a differential pressure signal. The differential pressure signal is thereafter applied to a function circuit which generates a pressure correction signal. An electronic control unit receives the pressure correction signal and utilizes it to modify the air/fuel ratio calibration according to the functional conversion. In the preferred embodiment the function circuit comprises a voltage controlled linear current source. In another implementation individual pressure sensors are used for each manifold to generate signals to a difference circuit which subtracts the intake manifold absolute pressure from the exhaust manifold absolute pressure to form the differential pressure signal. In either implementation incremental or proportional modification of a variable duration fuel pulse from the electronic control unit can be obtained by the pressure correction signal.

13 Claims, 11 Drawing Figures

INJECTION DRIVERS AND TIMING CIRCUIT
402
403
PWS
35
RST
SPEED SENSING CIRCUIT
404
SFS
405
PULSE WIDTH GENERATION CIRCUIT
406
CCC
411
SLOPE GENERATION CIRCUIT
410
θ
IMAP
PRESSURE SENSING CIRCUIT
408
MFS
409
θ
H2O TEMP
O2 AIR TEMP

405
SFS
A6
411
CCC
35
RST
502
504
+A
507
508
510
512
+A
A8
518
506
MFS
516
517
PWS
403
520
514
523
522
524
526

Fig-8
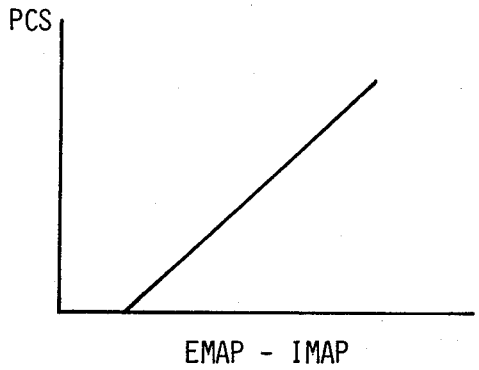
Fig-9a
Fig-9b
Fig-9c
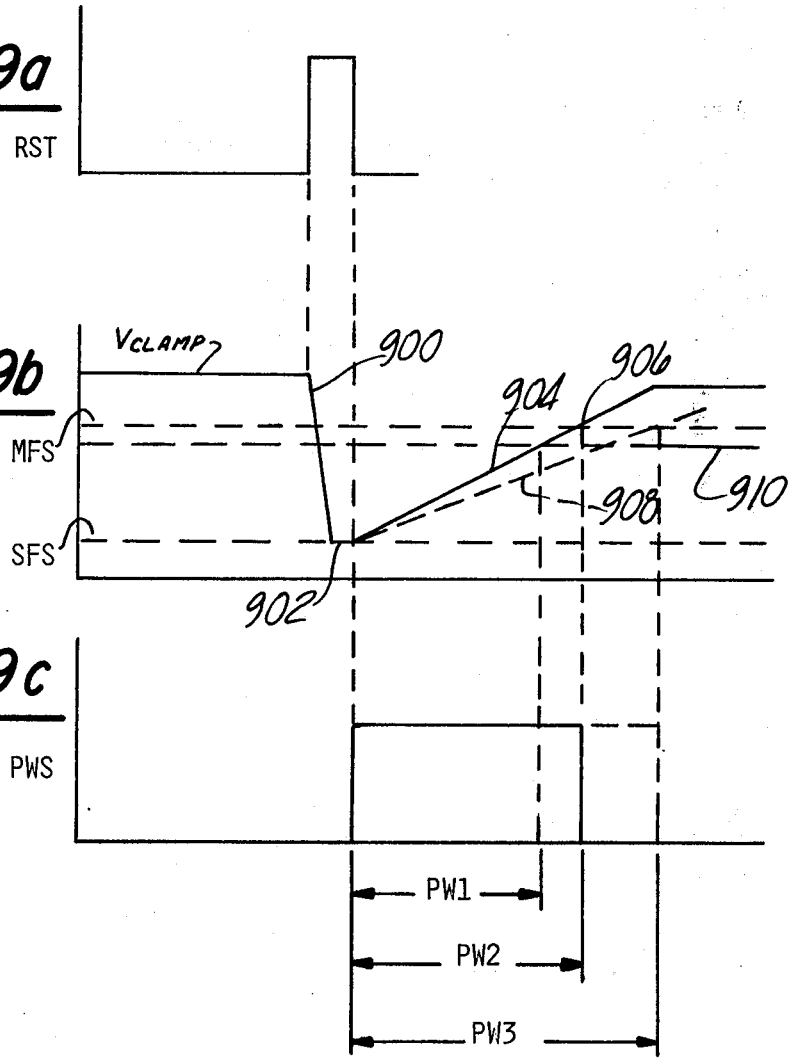

AIR/FUEL RATIO MANAGEMENT SYSTEM WITH CALIBRATION CORRECTION FOR MANIFOLD PRESSURE DIFFERENTIALS

BACKGROUND OF THE INVENTION

The invention pertains generally to electronic air/fuel ratio management systems and is more particularly directed to a calibration correction for such systems based upon the pressure differential between the exhaust manifold and intake manifold of the engine.

Electronic air/fuel ratio management systems have been developed whereby the quantity of fuel to be ingested into the intake manifold of an internal combustion engine is calculated from the measurement of various engine operating parameters. These parameters generally describe the mass air flow into the engine and primarily include the speed of the engine, the intake manifold absolute pressure and the air temperature. Other secondary parameters such as special calibrations for warm up conditions or for closed loop operation further comprise the engine coolant temperature and the composition of the exhaust gases in the exhaust manifold of the engine.

All the measured parameters are input into an electronic control unit which schedules the fuel quantity accordingly and produces an air/fuel ratio control signal. In one of the more widely used systems the air/fuel ratio control signal is provided by a pulse width signal having a variable duration. This pulse width signal, the duration of which is determined by the calculated or scheduled fuel quantity, is generated by a pulse width generation circuit of the electronic control unit at a cyclic rate dependent upon the speed of the engine. An injection apparatus or other fuel metering device responsive to the variable duration pulses of the ECU is then utilized to input the desired quantity of fuel into the engine.

An example of an advantageous air/fuel ratio management system of this type is described in an application U.S. Ser. No. 918,291 filed on June 22, 1978 in the name of Ralph W. Carp et al. which is commonly assigned with the present application. The disclosure of Carp et al. is hereby expressly incorporated by reference herein.

Generally, these air/fuel ratio management systems are used to advantage for the regulation of the air/fuel ratio of a spark ignited four-cycle internal combustion engine. In the operation of the conventional four-cycle internal combustion engine having intake, compression, power and exhaust cycles, an air/fuel ratio charge is input through an intake manifold into a cylinder where it is combusted, and the waste products output from the cylinder through an exhaust manifold. Control of the four separate timed cycles is accomplished by the opening and closing of intake and exhaust valves for each cylinder in a timed relationship.

During the closing of the exhaust valve and the opening of the intake valve, there is some valve overlap wherein both the intake valve and the exhaust valve are for a very short period open at the same time. Because of the higher pressure in the exhaust manifold than in the intake manifold during this overlap some of the exhaust gas will be recirculated into the next incoming air/fuel ratio charge. This constitutes an internal exhaust gas recirculation (EGR) wherein the leakage of noncombustible waste gases dilutes the incoming air/fuel ratio into a richer charge than the electronic control unit believes it has scheduled. This is because not all the fuel input into the cylinder can be combusted with the extra amount of nonburnable exhaust gases.

Generally the amount of internal leakage is relatively small and the valve overlap fairly constant for a specified engine configuration. Until recently this internal EGR has not posed a substantial problem to air/fuel ratio control because other sources of air/fuel ratio error tended to mask its effect. With the advent of precision electronic controllers this air/fuel ratio error is now one that can and should be compensated. It would therefore be advantageous to compensate the air/fuel ratio management system in proportion to the dilution produced by the internal EGR.

It has been found that the amount of internal EGR leakage varies primarily as a function of the changes in pressure in the exhaust manifold and the intake manifold at a constant engine speed. It would therefore be desirable to provide the internal EGR compensation as a function of the pressure changes in the intake and exhaust manifolds.

The pressure changes in these two manifolds however can not be described simply as each may contain variable restrictions to flow which change with the various operating conditions or parameters of the engine. Common exhaust manifold restrictions found today are catalytic converters and noise suppressors that have different flow characteristics at different temperatures and humidity conditions. Further, the exhaust manifold pressure will increase nonlinearly with the speed of an engine even with a fixed restriction.

The most common variable intake manifold restrictions are the throttle plate which regulates the air flow to the engine, the automatic choke used at different engine temperature settings, and any filtering apparatus placed in series with the manifold such as a common air cleaner.

Further the absolute pressures found in the intake manifold and exhaust manifold will vary with the altitude of engine operation and cause different amounts of internal EGR at different throttle positions. As the intake manifold is throttled ambient pressure changes usually affect the exhaust manifold absolute pressure more significantly than the intake manifold absolute pressure.

Generally, modern electronic control units contain an altitude compensation circuit for the density changes caused by shifts in altitude. An exemplary circuit of this type is found in the Carp et al. reference and includes compensation for EGR drop out with increasing altitude.

Another major variable restriction found on more automotive systems today is the turbocharger. Generally, such a system comprises a turbine placed in a restricting manner in the exhaust gas flow which is mechanically coupled to a rotor or air pump for providing boost pressure to the intake manifold. These restrictions are variable for both the intake and exhaust manifold as they change nonlinearly with respect to the rotational velocity at which they are operating.

For example, a stalled or stationary turbine exhibits a much greater restriction to exhaust gas flow than when the turbine is rotating. Further, if a waste gate type of turbocharger system is used wherein the turbine is always rotating, the variable waste gate will produce a variable restriction based upon an operator setting.

Particularly, on rapid accelerations the exhaust manifold pressure of a turbocharger system will not initially follow the pressure change in the intake manifold caused by the opening of the throttle. The lag in equalizing the pressure changes between the manifolds as the turbine builds up to speed may cause significant air/fuel ratio error.

All of the above mentioned restrictions provide variable amounts of internal EGR which dilute the incoming air/fuel ratio charge from that calculated to produce an air/fuel ratio error for the engine. The amount of internal EGR or air fuel ratio error on an absolute scale is directly related to the pressure differential between the two manifolds. Assuming the valve overlap remains substantially constant, it would be highly advantageous to utilize this parameter to correct the calibration for the error.

SUMMARY OF THE INVENTION

The invention provides a method and apparatus for correcting the calibration of an air/fuel ratio management system as a function of the pressure differential between the exhaust manifold and the intake manifold of an engine. The calibration will correct for the enrichening effect of internal EGR across the valve overlap of the engine as a result of the various pressure changes occuring in the intake and exhaust manifolds.

In the preferred embodiment the apparatus includes means for generating a differential pressure signal which represents the difference between the absolute pressure of the exhaust manifold and the absolute pressure of the intake manifold. The apparatus further includes a differential pressure function circuit for receiving the differential pressure signal and generating a pressure correction signal as a function of the pressure difference. The pressure correction signal is then input to an electronic control unit to vary the air/fuel ratio of the engine in accordance therewith.

In one implementation the differential pressure signal is generated by providing a differential pressure sensor with two pressure inputs. One pressure input is coupled in communication with the intake manifold and the other pressure input is coupled in communication with the exhaust manifold. The output of the differential sensor is thereafter electrically connected to the differential pressure function circuit to transmit the differences in manifold pressures thereto.

An alternative implementation includes two pressure sensors where one sensor is operably in communication with the intake manifold and the other sensor is operably in communication with the exhaust manifold. The signals from the individual sensors representative of the absolute pressure of the intake manifold and the absolute pressure of the exhaust manifold respectively are applied to a different circuit which generates the differential pressure signal. This differential pressure signal is thereafter applied to the differential pressure function circuit to calculate the pressure correction signal.

This alternative implementation is most applicable to an air/fuel ratio management system based upon a speed-density calibration with an intake manifold pressure sensor. The intake manifold sensor can then serve the dual purpose of providing a pressure signal for the base calibration and the calibration correction thereby matching the two compatibly. Since only a single input rather than a differential input sensor is needed for the exhaust manifold additional accuracy can be justified.

The pressure correction signal varies the air/fuel ratio of the internal combustion engine in a desired manner by preferably controlling the duration of a pulse width signal generated from the electronic control unit. In an advantageous implementation the electronic control unit generates each pulse of the signal as a function of a initiating signal level, a charging current slope, and a termination signal level. The pressure correction signal is used to modulate one or more of these parameters used in the generation of the pulse width.

In one form of the invention the pressure correction signal is interfaced with the ECU to provide an incremental change in pulse width by modifying the termination level of the pulse width and in another form of the invention the pressure correction signal is interfaced with the ECU to modify the pulse width proportionately by changing the slope developed by the charging current.

A preferred form of the differential pressure function is a linear change in the pressure correction signal with respect to changes in the differential pressure signal. In a circuit implementation the linear change is produced by a voltage control current source which incrementally increases a current output representative of the pressure correction signal for changes in a voltage input indicating the differential pressure signal.

These and other features, advantages, and objects of the invention will be more fully understood and better explained if a reading of the following Detailed Description is undertaken in conjunction with the appended drawings wherein.

BRIEF DESCRIPTION OF THE DRAWINGS

FIG. 8 is a functional representation graphically illustrating the pressure correction signal as the linear function of the differential pressure signal (EMAP-IMAP);

FIGS. 9*a–c* are illustrative waveform representations of signals utilized for calculation of the pulse width signal by the pulse width generation circuit illustrated in FIG. 5.

DETAILED DESCRIPTION OF THE PREFERRED EMBODIMENTS

Figure 1:
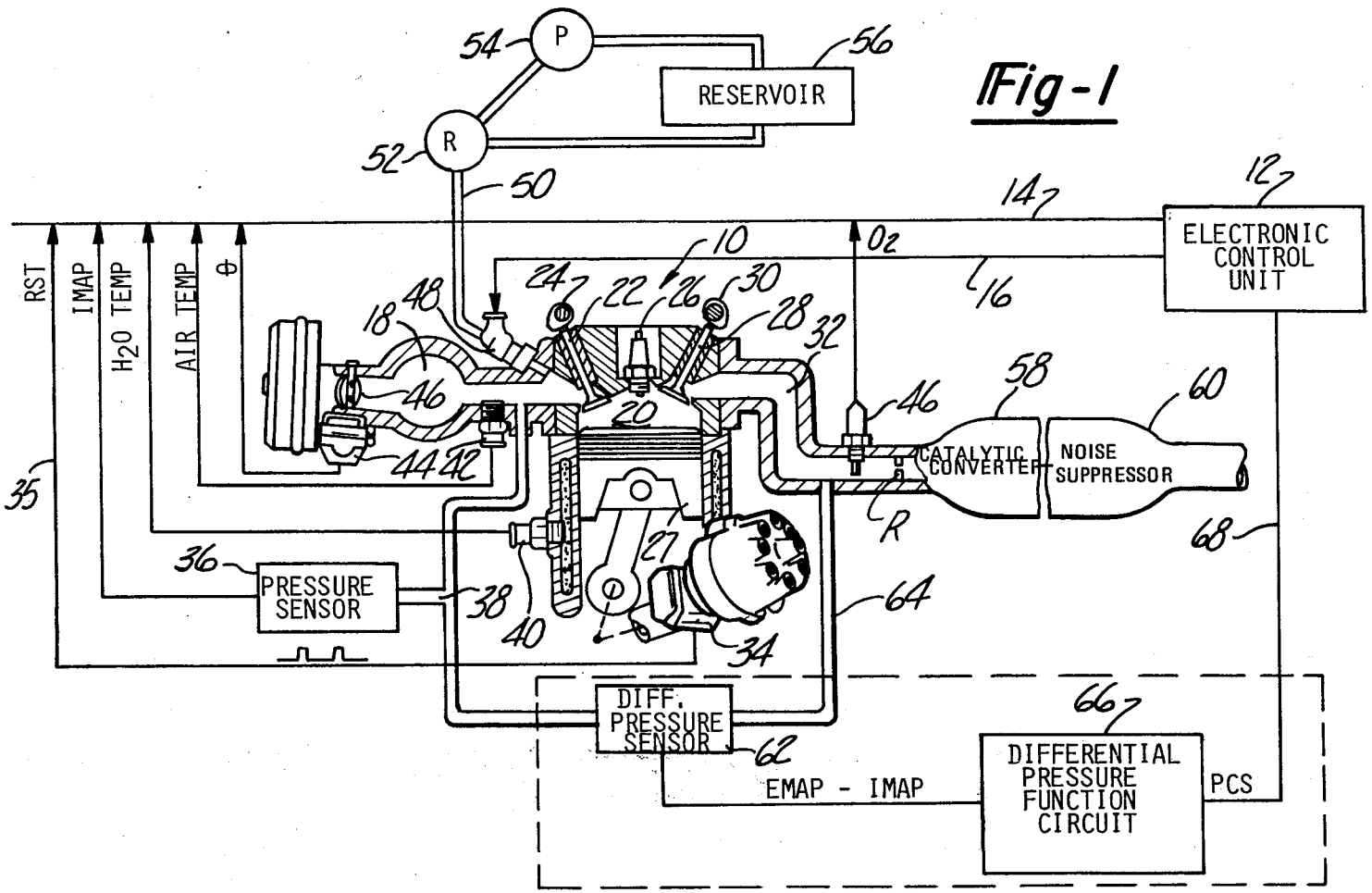
FIG. 1 is a system schematic and block diagram of an internal combustion engine having an air/fuel ratio management system with a differential pressure calibration correction constructed in accordance with the invention.

FIG. 1 illustrates an engine 10 of the internal combustion type having an air/fuel ratio management system including an electronic control unit 12. The engine 10 has numerous sensors that develop electrical signals based upon the operating conditions of the engine. The signals are transmitted to the electronic control unit from the sensor via a signal bus 14 for electronic processing. The electronic control unit 12 calculates or schedules an air/fuel ratio control signal based upon the input parameters and regulates the air/fuel ratio with this control signal via a control line 16.

Electronic control of the air/fuel ratio increases the precision of the regulation during the constantly changing load, speed, and temperature conditions of the engine. As is known, this precise control in combination with presently available catalytic converters that eliminate certain exhaust products is utilized to reduce noxious emissions of the engine while maintaining driveability and good fuel economy.

The electronic control of this illustrated system is based upon an open loop calibration of an air/fuel ratio charge inducted through an intake manifold 18 into a combustion chamber 20 of a cylinder of the engine 10. The induction occurs through an open intake valve 22 during a downstroke of a piston 27 on an intake cycle. The intake valve 22 is operably reciprocated by the rotation of a cam shaft 24 mechanically chained in a timed relationship to the driveshaft of the engine. The air/fuel ratio charge is thereafter compressed by an upstroke of piston 27 and ignited by a timed spark device 26 during a compression cycle. The combustion drives the piston 27 downward in a power stroke to rotate the crankshaft of the engine. The waste products of the combustion are output from the cylinder during a following exhaust cycle through an exhaust valve 28 opened in a timed relationship by another cam shaft 30 mechanically connected to the driveshaft. The opening of the exhaust valve 28 will allow the combusted gases to be discharged into an exhaust manifold 32 and thereafter exit into the atmosphere.

Only one cylinder of operation for engine 10 has been shown in FIG. 1 for the purpose of clarity, but it is generally understood that the present description will be applicable to any multi-cylinder engine such as an 8 cylinder automotive as indicated by the distributor cap in the figure. The present system can also, as will be obvious to one skilled in the art, be easily adapted to any multi-cylinder internal combustion engine including a compression ignited internal combustion engine.

In the preferred implementation shown, the electronic control unit 12 schedules the air/fuel ratio control signal from a reset signal RST developed by a speed sensor 34. The signal RST is provided as a pulsed signal whose frequency is dependent upon the rotational velocity of the crankshaft or a rotating member attached thereto; i.e., the distributor shaft. An intake manifold absolute pressure signal IMAP is generated to the ECU by an analog pressure sensor 36 communicating with the intake manifold 18 via a conduit 38. These two signals generally provide the information needed for a speed-density or a basic mass air/flow calculation of the electronic control unit 12. Corrections for this basic open-loop calibration are provided by a coolant temperature signal $H_2O$ TEMP from a temperature sensor 40 located in the cylinder water jacket. Other density corrections are provided from an air temp signal provided by temperature sensor 42 communicating with the intake manifold 18. Generating a throttle signal $\theta$ indicating the relative opening of the throttle is a rotating position switch 44 mechanically ganged to the throttle 46. Additionally, a closed loop correction signal $O_2$ based upon the constituent composition of the exhaust gases is provided by an oxygen sensor 46 located in the exhaust manifold 32 of the engine.

From these operating parameters, the electronic control unit 12 develops the fuel regulation signal as a pulse width whose duration varies with the quantity of fuel to be supplied. This pulse width is applied to a fuel metering apparatus shown as a solenoid type fuel injector 48 in FIG. 1 that has pressurized fuel input from a supply line 50. The supply line 50 is pressurized by a pressure regulator 52 operating in conjunction with a fuel pump 54 which circulates the fuel into the supply line from a reservoir 56. The pulsed signal is operative to open a valve in the injector to allow the pressurized fuel to be injected through a nozzle into the incoming air flow within manifold 18.

During the system operation, the opening of the intake valve 22 and the closing of the exhaust valve 28 will overlap. This condition where both valves are slightly open occurs at the beginning of an intake cycle and the end of an exhaust cycle for the conventional 4-cycle engine. The overlap can be controlled by the positioning and geometry of the lobes of cam 24 which is illustrated opening intake valve 24 and cam 30 illustrated closing exhaust valve 28. However, the valving mechanism does exhibit inertial lag and the opening and closing times can not be reduced to where the valves bounce without severly limiting their working lifetime. Therefore, some overlap of a substantially instant nature will be built into most engine configurations. Depending upon the pressure in the intake manifold 18 and the pressure in the exhaust manifold 32, the value overlap will cause a variable amount of exhaust gases to be internally recirculated into the incoming air/fuel ratio charge diluting the calculated air/fuel ratio.

The amount of recirculated exhaust gas will be dependent upon the speed of the engine and the restrictions presented to flow through the intake manifold and exhaust manifold. Generally, most of these restrictions are variable with engine operating conditions. Commonly, such restrictions in the exhaust manifold schematically designated by the restriction R are a catalytic converter 58 and a noise suppressor, or muffler 60 connected serially between the exhaust manifold and the atmosphere. These restrictions will change with absolute ambient temperature and pressure, the engine temperature and condition, the speed of the engine and other variable factors. A common variable restriction in the intake manifold, of course is the throttle valve 46 which operably controls airflow by its rotation therein.

To correct the air/fuel ratio for the dilution of the internally circulated EGR, the invention provides a means for sensing the difference in pressure between the intake manifold and the exhaust manifold. In the embodiment shown in FIG. 1, this is a differential pressure sensor 62 having two pressure inputs. One pressure input is communicated to the intake manifold 18 via the conduit 38 and the other pressure input is communicated to the exhaust manifold 32 via a conduit 64. The differential pressure sensor 62 therefore generates an analog differential pressure signal which is a voltage representation of the difference between the exhaust manifold absolute pressure EMAP and the intake manifold absolute pressure IMAP. Absolute pressures are measured and they compensate for altitude changes directly as they affect the pressures in either manifold.

The differential pressure signal is input to a differential pressure function circuit 66 which generates a pressure correction signal to the electronic control unit 12 via line 68 as a function of the pressure difference. The pressure correctional signal PCS will, modify the air/fuel ratio to the lean side and compensate for the dilution of the internal EGR.

The calibration correction is preferably one that will lean the incoming air/fuel ratio enough to combust all of the injected fuel. This will schedule appropriately a stoichiometric air/fuel ratio which with the aid of the catalytic converter 58 reduces exhaust pollution products.

The pressure in the intake manifold will vary from a low pressure value below atmospheric at closed throttle to almost atmospheric pressure at wide open throttle. The exhaust manifold will be at its lowest pressure at idle and will increase steadily with increases in engine speed. The absolute difference in pressure will be the greatest at high engine speeds and low loads and the lowest at low engine speeds and wide open throttle. The differential pressure calibration will correct for the internally recirculated EGR between these two extremes.

Figure 2:
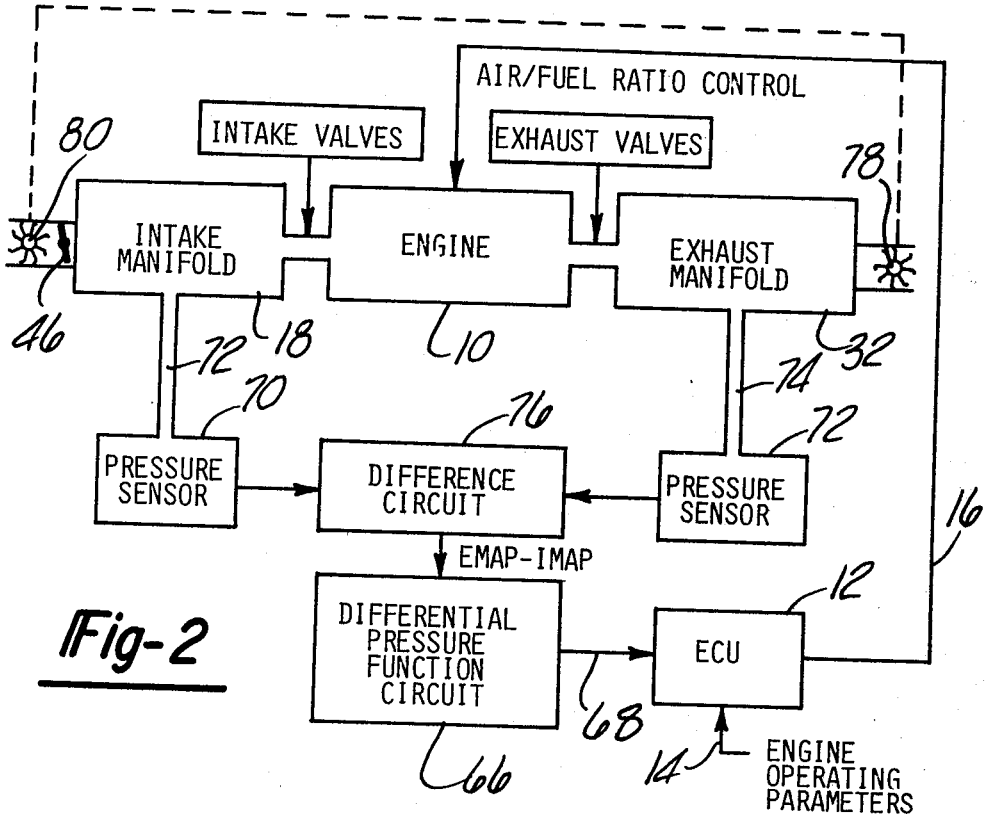
FIG. 2 is a schematic view of an internal combustion engine having an alternative implementation for the differential pressure calibration correction.

FIG. 2 illustrates another preferred embodiment of the system whereby the differential pressure signal is generated by individual pressure sensors 70 and 72 instead of the single differential pressure sensor 62. This permits the IMAP signal from the pressure sensor 70 to serve the dual purpose of being used for the difference calibration and also as an input to the basic speed density calculation. Both sensors can be more sensitive for the same cost as the alternative configuration and errors between the sensors minimized.

The pressure sensor 70 has a pressure input corrected to the intake manifold via conduit 72 and provides a signal representative of the intake manifold absolute pressure IMAP. The pressure sensor 72 has a pressure input communicating with the exhaust manifold 32 via conduit 74 and generates a signal representative of the exhaust manifold absolute pressure EMAP. These signals are presented to a difference circuit 76 to form the differential pressure signal. The differential pressure signal in a similar manner to the alternate embodiment is input to the pressure function circuit 66.

Also disclosed in this embodiment is another example of a variable restriction that is nonlinear and changes with engine operating conditions. In the exhaust manifold is a turbine 78 of a turbocharger which is mechanically connected and rotates an air pump 80 to apply boost pressure to the intake manifold 18. Alternatively, it is known that the boost pressure may be applied by a separate conduit to the intake manifold and not form a restriction therein.

When the throttle valve 46 is opened quickly for an acceleration the intake manifold pressure for the embodiment shown rises quickly to atmospheric and the exhaust manifold pressure begins to rise because of the increasing speed of the engine. However, the exhaust manifold pressure increases much faster than in a normally aspirated engine because of the stalled turbine 78. As the turbine 78 picks up speed, the pressure in the exhaust manifold will become more nearly that of the normally aspirated engine under the same conditions, but the intake manifold pressure will begin to increase to a positive pressure so the air pump 80 produces boost. With these transient pressure changes various amounts of internal EGR will be generated according to the instantaneous pressure differential between the manifolds. The invention therefore will compensate the air/fuel ratio for the variable EGR caused by the turbocharger.

Figure 3:
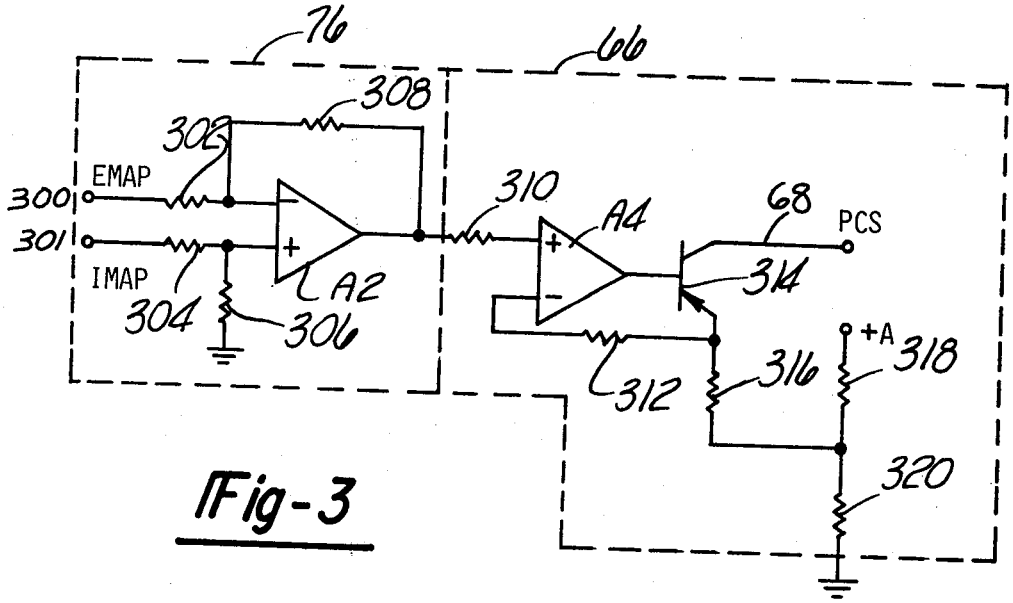
FIG. 3 is a detailed electrical schematic diagram of the difference circuit and differential pressure function circuit illustrated in FIG. 2.

Referring now to FIG. 3, there is shown a detailed schematic of a circuit implementation of the preferred difference circuit 76 and the differential pressure function circuit 66. The difference circuit 76 is formed from a differential amplifier A2 receiving the exhaust manifold absolute pressure signal EMAP to its inverting input through a resistor 302 from terminal 300. At the noninverting input of the amplifier A2, the intake manifold absolute pressure signal IMAP is input from the junction of a divider formed from resistors 304, 306 connected between the input terminal 301 and ground. The difference circuit 76 further comprises a feedback resistor 308 connected between the output of the amplifier A2 and the inverting input. The amplifier A2 acts as an inverting subtractor with a gain proportional ratio of the resistors 308 and 302. The functional output from this circuit to the differential pressure function circuit 66, therefore, is (EMAP-IMAP) which is an inversion of the differential pressure signal.

The differential pressure function circuit 66 preferably comprises a voltage controlled current source which has a linear current slope and a threshold level. The current source comprises an amplifier A4 having a feedback loop through a resistor 312 from the emitter of a source transistor 314 to its inverting input. At the non-inverting input the amplifier A4 receives the voltage representative of the differential pressure signal (EMAP-IMAP) via a resistor 310. Resistor 312 and resistor 310 are chosen equivalent to equalize the current into the inputs of the amplifier for the same voltages. The amplifier A4 controls the conductance of the transistor 314 by its output connection to the base terminal thereof and modulates the current supplied through the collector emitter junction of the transistor. The slope at which the current changes is developed by the value of a resistor 316 connected between the emitter of the transistor 314 and a threshold voltage. The threshold voltage is developed at the junction of a pair of divider resistors 318 and 320 connected between a source of positive voltage +A and ground. The pressure correction signal PCS is the output current from the circuit through terminal line 68 to the ECU.

Referring still to the detailed circuitry of FIG. 3 but now in conjunction with the functional representation of the variables in FIG. 8, operationally it is seen that the difference between the EMAP and IMAP signals must exceed a threshold voltage before a current will be supplied through the collector of the transistor 314. For differences smaller than the threshold, the voltage on the noninverting input of the amplifier A4 will be greater than the threshold voltage applied to the inverting input via the slope resistor 316 and the feedback resistor 312. The source transitor 314 will be in a non-conducting condition during this time. As the difference in pressures increases, the voltage input through resistor 310 will drop below the threshold and the amplifier A4 will attempt to maintain the emitter of transistor 314 at the voltage output from the difference circuit 76. This will cause more current to be drawn through resistor 316 dropping the voltage at that point in accordance with the conductivity of the transistor. The PCS signal, therefore, will be a linearly increasing current as the difference between the signal EMAP and the signal IMAP becomes greater with a slope dependent upon resistor 316. The threshold is generally set to be the minimum pressure differential that the engine will normally experience in operation. The threshold will protect the system from transient conditions where the sensors might indicate a higher pressure present in the intake manifold than is present in the exhaust manifold.

Although the preferred implementation shows the differential pressure function circuit 66 as generating the PCS signal current as a linear function of the differential pressure signal voltage, it will be obvious to one skilled in the art that much more complex functions can be utilized. Moreover, either a voltage or current representation of any function can be generated or other electrical forms.

Figure 4:
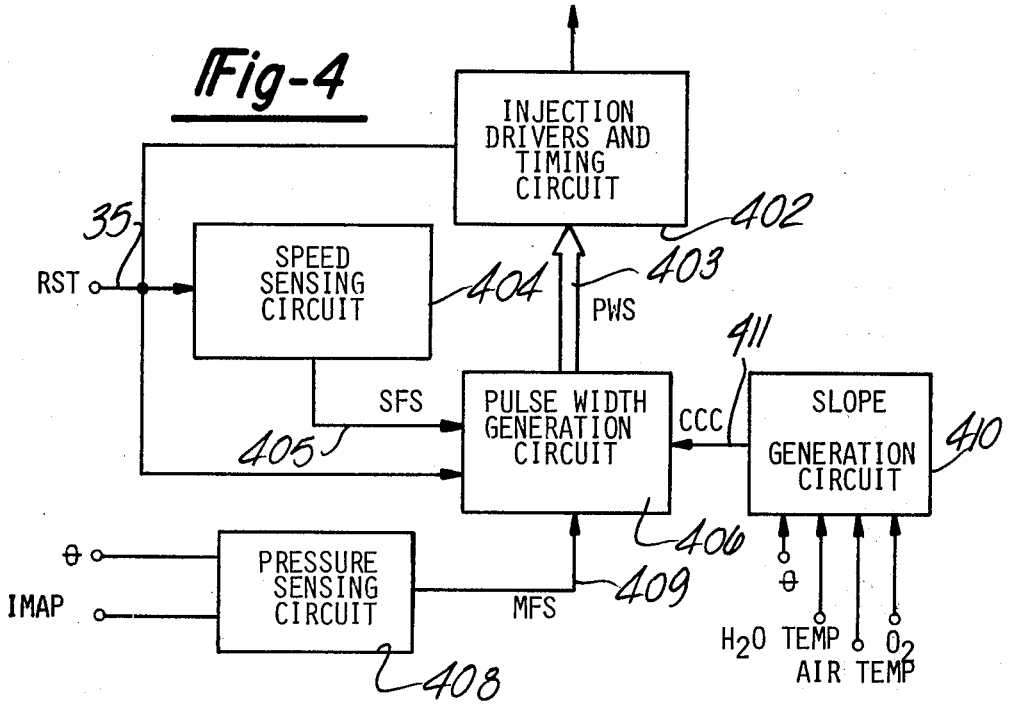
FIG. 4 is a detailed block diagram view of the electronic control unit illustrated in FIGS. 1 and 2.

With attention now directed to FIG. 4, there is shown a detailed block diagram of a preferred electronic control unit 12 that outputs a pulse width signal to control a fuel metering apparatus as was previously described. The electronic control unit 12, which is illustrated additionally in the referenced Carp et al. application, has a main pulse width generation circuit 406 which develops a pulse width signal PWS and transmits it to a driver and timing circuit 402. The driver and timing circuit 402 transforms the pulse width signal to the correct voltage and current levels for energizing the fuel metering apparatus of the engine. The driver and timing circuit 402 can be further used to gate the pulse width signal to separate fuel injector groups if more than one is occasioned by the system configuration.

The pulse width generation circuit 402 develops the PWS signal from four separate input signals. The first is a timing signal indicating the angular event of the engine related to the speed or RST signal input via line 35. This timing signal is used to initiate the start of the pulse width at a voltage level SFS comprising the second input transmitted through line 405 from a speed sensing circuit 404. The speed sensing circuit 404 also receives the RST signal and develops the voltage level, SFS, as a function of the speed. In the Carp et al. reference this particular function is described as a bilevel signal with a decay from one level to the other based upon an engine idle speed.

From the initial voltage level SFS a variable voltage slope is generated by a current signal CCC from a slope generation circuit 410 charging a timing capacitor. The voltage slope when it intercepts another voltage level MFS provided by a pressure sensing circuit 408 via line 409 terminates the pulse width signal. The slope generation circuit 410 provides the current signal CCC as a function of the throttle angle signal $\theta$, the water temperature signal $H_2O$ TEMP., the air temperature signal, AIR TEMP., and the exhaust gas composition signal $O_2$. The MFS signal is generated by the pressure sensing circuit 408 which has input thereto the intake manifold absolute pressure signal IMAP and also the throttle angle signal $\theta$. Essentially the PWS signal is comprised of variable duration pulses generated synchronously with the RST signals. The pulses are lengthened or shortened primarily by the termination level MFS which is a function of the intake manifold pressure. This will produce a pulse duration based on a speed density calibration. The other secondary corrections to the pulse width are generated by modification of the current signal CCC appropriately with the desired change.

Figure 5:
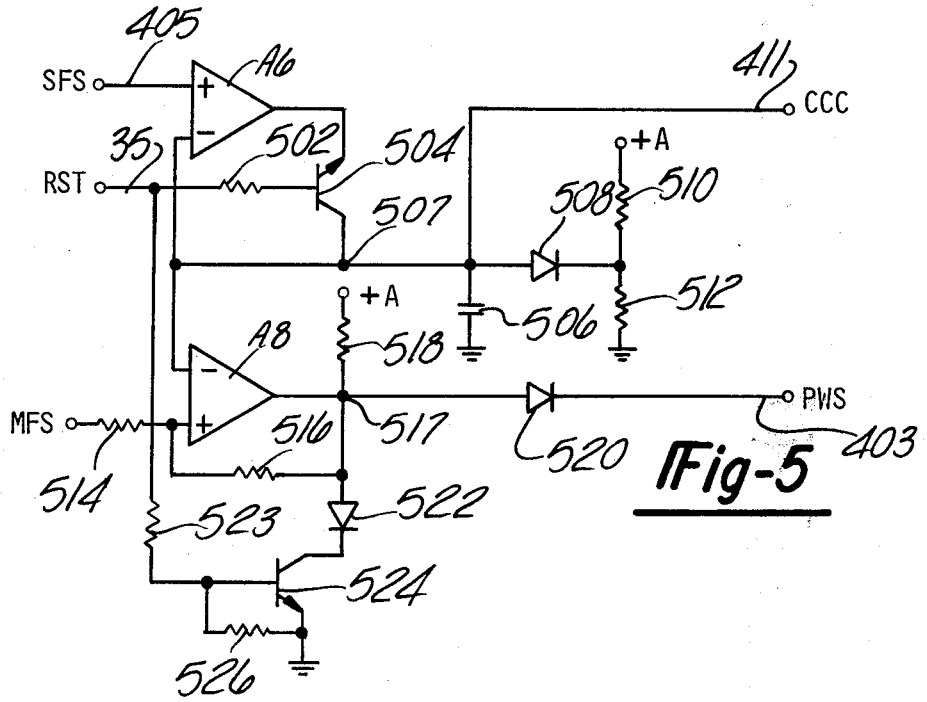
FIG. 5 is a detailed electrical schematic of the pulse width generation circuit of the electronic control unit illustrated in FIG. 4.

With reference now to FIG. 5, the detailed circuitry comprising the pulse width generation circuit 406 is shown. The pulse width generation circuit 406 comprises basically an operational amplifier A8 operating as a comparator having its inverting input connected at a voltage node 507 to one terminal of a timing capacitor 506 whose other terminal is connected to ground. At the noninverting input of the amplifier A8 via input resistor 514 is received the manifold function signal MFS from a terminal line 409 which connects to the pressure sensing circuit 408. The output of the amplifier A8 is connected to a node via 517 which is provided with current pull up via a resistor 518 connected between the node and a positive source of voltage +A. A hysteresis resistor 516 is further connected between the node 517 and the noninverting input of the amplifier A4. The output of the amplifier A8 is the PWS signal and is generated through a blocking diode 520 to the injection driver and timing circuit over conductor line 403.

The charging current signal CCC is connected via line 411 to the node 507 to charge the capacitor 506 at a controllable rate and provide a variable slope ramp. A discharge path for the capacitor 506 is provided by a transistor 504 connected with its collector to node 507 and its emitter to the output of the amplifier A6. The transistor 504 receives at its base the RST signal from input line 35 through resistor 502. The operational amplifier A6 further has its inverting input connecting to node 507 and its noninverting input receives via terminal line 405 the speed function signal SFS.

A clamping circuit for the capacitor 506 is provided comprising a diode 508 and a pair of resistors 510 and 512. Node 507 is coupled to the anode of the diode 508 and thereafter its cathode coupled to the junction of the divider resistors 510 and 512 which are connected between a source of positive voltage +A and ground.

Completing the pulse generation circuit 406 is a holding circuit comprising a transistor 524 connected with its collector to the node 517 through a blocking diode 522 and having its emitter connected to ground. The transistor 524 further receives at its base the RST signal via the junction of a pair of divider resistors 523 and 526 connected between the signal line 35 and ground.

For the operation of the circuit of FIG. 5 attention is now directed to the waveform drawings FIGS. 9A through 9C where it is seen that the RST signal is a pulse occurring at a rate dependent on the speed of revolution of the engine. One pulse width of signal PWS seen in FIG. 9C is generated for each RST signal and is synchronous to the trailing edge thereof. FIG. 9B illustrates the voltage on the timing capacitor 506 which in combination with the amplifier A8 determines the duration of the pulse width signal PWS.

Initially for pulse generation the timing capacitor 506 has been charged to a voltage $V_{clamp}$ which is equivalent to the voltage at the junction of the divider resistors 510 and 512. The capacitor 506 is fully charged to the clamp voltage by the continuous current provided to the node 507 by the CCC signal but will not charge further because of the forward biasing of the diode 508 when the voltage on the capacitor exceeds the clamp voltage by approximately 0.6 of a volt.

At some instant the pulse signal RST is applied to the base of the transistor 504 thereby turning it on. Since the noninverting input of the amplifier A8 is connected to node 507 which is at the clamp voltage and higher than the SFS signal, the output of the amplifier A6 becomes conductive allowing the transistor 504 to discharge the capacitor 506 through the amplifier output to ground. This discharge takes place quickly as is shown on the waveform of FIG. 9B at 900.

Once the voltage level on the capacitor 506 has reached the SFS level at 902, the amplifier A6 will shut off and no longer allow the capacitor 506 to discharge. At this point the voltage of the inverting input of the amplifier A8 is that of the capacitor 506 and at a level equivalent to the SFS signal.

During the entire time that the RST signal is present transistor 524 is turned on via the resistor divider combination of 523 and 526 and through diode 522 grounds the output of the amplifier A8 and pull up resistor 518 to clamp the voltage at node 517 low. The output of amplifier A8 would normally go high because of the relatively low voltage SFS provided on its inverting input via the capacitor 506 and the relatively high voltage on its noninverting input via the MFS signal. Once the RST signal is terminated transistors 504 and 524 become nonconductive. The capacitor 506 and hence the inverting input of the amplifier A8 will begin to charge according to the current supplied by the signal CCC. This increasing voltage shown at 904 ramps toward the MSF level and initiates the generation of the pulse PW2. When the voltage on the capacitor 506 exceeds the MSF signal at 906, the amplifier A8 will switch back to a conducting operation and the PW2 signal will go low.

According to the invention the pulse width signal and hence the quantity of fuel delivered by the fuel metering device can be varied by the pressure correction signal PCS. In one embodiment to be illustrated the PCS signal is used to modify the current signal CCC to change the slope of the charging ramp of capacitor 506. An example of lowering the slope is shown at 908 in FIG. 9B and will extend the pulse width to PW3 as seen in the drawings. Another embodiment contemplates using the pressure correctional signal PCS to modify the MFS voltage level, for example, to level 910 and shorten the pulse width to PW1. From this discussion it can be readily understood that by varying either the initial voltage level SFS, the final voltage level MFS, or the slope of the charging current, signal CCC with the PCS signal, that the pulse width signal PWS either may be lengthened or shortened accordingly.

Figure 6:
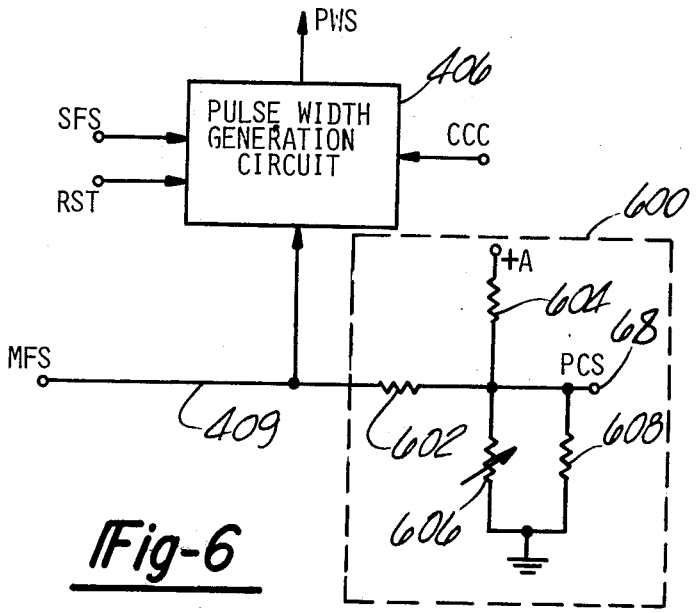
FIG. 6 is a partially block and partially schematic view of an interface between the differential pressure function circuit and the electronic control unit illustrated in FIG. 5.

FIG. 6 illustrates one preferred implementation of combining the PCS signal with the MFS signal whereby an incremental change in the pulse width is provided for an incremental change in the PCS current. In this implementation an interface circuit 600 is connected to the MFS signal line via resistor 602. Resistor 602 communicates an offset voltage formed at the junction of a pair of divider resistors 604 and 606 connected between a source of positive voltage and +A and ground.

The resistor 606 is a variable resistor that can be adjusted to produce a desired offset according to the calibration desired. In parallel with the variable resistor 606 is a voltage generating resistor 608 connected between the differential pressure function circuit via line 68 and ground. The resistor 608 receives the current from the pressure correctional signal PCS and transforms it into a voltage which varies the offset accordingly. This voltage is, generated at the terminal 68, is combined with the MFS signal in an analog addition to change the pulse width in the pulse generation circuit 406.

Figure 7:
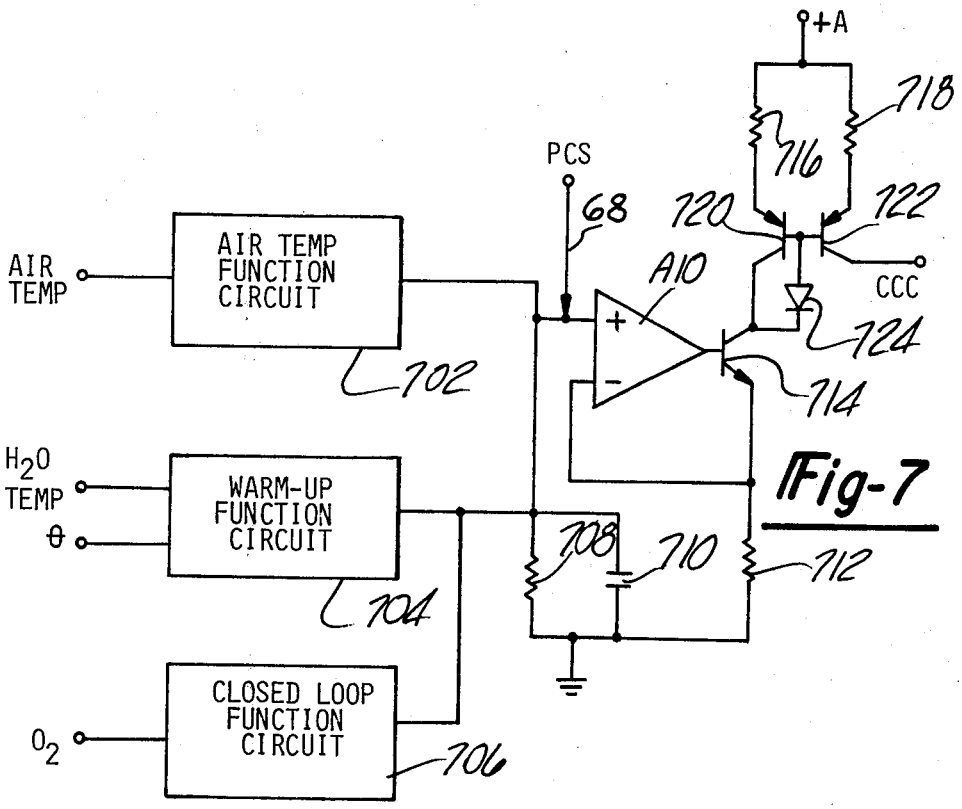
FIG. 7 is a partially block and partially schematic view of the slope generation circuit illustrated in FIG. 4 and indicates the interfacing of the pressure correctional signal.

The other implementation for combining the current signal PCS with the slope generation current CCC is illustrated in FIG. 7. This combination produces a proportional variation in the pulse width where a change in current will produce a proportionally greater change in pulse width. The PCS signal current is input to the slope generation circuit via signal line 68.

The slope generation circuit 410 is generally formed by a voltage control current sink having an amplifier A10 connected at its output terminal to a control transistor 714. The control transistor 714 has its emitter connected in a feedback loop to the inverting input of the amplifier A10 and further to ground through an emitter resistor 712. The collector of the control transistor 714 is connected to the cathode of a diode 724 whose anode is commonly connected to the base terminals of a pair of mirror transistors 720 and 722. The mirror transistors 720 and 722 have their emitters through resistor 716 and 718 respectively connected to a source of positive voltage +A. The collector of the transistor 722 is the output terminal for the generation of the current signal CCC and the collector of transistor 720 is connected to the collector of the control transistor 714. Input to the voltage control current sink is at the noninverting input of the amplifier A10 which has the parallel combination of the resistor 708 and the filter capacitor 710 connected therebetween and ground.

The input of a current to the noninverting input of amplifier A10 will create a voltage across resistor 708 and cause the control transistor 714 to modify its conductance to pull a predetermined amount of current through resistor 712 to equalize the voltages at the inputs of the amplifier. The controlled amount of current pulled through the control transistor 714 will regulate the amount of current flowing through the resistor 716 by the amplification factor of the transistor 720. The transistor 722 therefore will mirror that current drawn by the matched transistor 720 to provide the CCC signal. Normally, the CCC signal is controlled by current inputs to resistor 708 from an air temp function circuit 702, a warm up function circuit 704, and a closed loop function circuit 706. These circuits receive the various input parameters mentioned and generate current signals as functions of the variables. An analog addition of the currents is accomplished by the resistor 708 to produce the control voltage. For the present implementation the PCS current from circuit 66 may also be provided to the analog addition to further vary the pulse width proportionally to the current provided.

The variation in pulse width for the interfacing of the PCS signal in FIG. 7 is proportional because the slope generation circuit 410 modifies the pulse width as 1/e for increases in current input to resistor 708. Thus, for pressure changes the PCS current signal will vary the pulse width similarly if this interface is used. Normally, the PCS current is not a substantially large percentage of the input to resistor 708 and can therefore over the many ranges of interest be approximated by a linear slope.

While the preferred embodiments of the invention have been shown it will be obvious to those skilled in the art that modifications and changes may be made to the disclosed system without departing from the spirit and scope of the invention as defined by the appended claims.

What is claimed as having an exclusive right therein is:

1. An air/fuel ratio management system for an internal combustion engine having an intake manifold and an exhaust manifold, said system comprising:

electronic control means for regulating the air/fuel ratio of the engine by controlling the amount of fuel supplied to the engine in response to at least one engine operating parameter;

means for sensing the difference in pressure between the intake manifold of the engine and the exhaust manifold of the engine and for generating a differential pressure signal indicative of that pressure difference; and means responsive to said intake manifold pressure and said differential pressure signal for generating a pressure correctional signal for said electronic control means for regulating the air/fuel ratio of the engine.

2. An air/fuel ratio management system as defined in claim 1 wherein said electronic control means includes:

fuel injection means regulated by said electronic control means for injecting a controllable amount of fuel into the engine.

3. An air/fuel ratio management system as defined in claim 2 wherein:

said electronic control means regulates said fuel injection means with a pulse-width signal whose duration is representative of the quantity of fuel to be injected.

4. An air/fuel ratio management system as defined in claim 3 wherein:

said correctional signal modifies said pulse width signal proportionately.

5. An air/fuel ratio management system as defined in claim 3 wherein:

said correctional signal modifies said pulse width signal incrementally.

6. An electronic control unit for calculating the quantity of fuel to be input to an internal combustion engine having an intake manifold and an exhaust manifold, said electronic control unit comprising:

means for calculating the quantity of fuel based upon the mass air flow through the intake manifold of the engine, and for generating a fuel quantity signal representative thereof and corrections thereto;

means for sensing the difference in pressure between the intake manifold of the engine and the exhaust manifold of the engine and for generating a differential pressure signal indicative of that pressure difference;

means responsive to said differential pressure signal for generating a correctional signal to modify said fuel quantity signal.

7. An electronic control unit as defined in claim 6 wherein:

said differential pressure means include a differential pressure sensor having a first pressure input in communication with the intake manifold and a second pressure input communicating with the exhaust manifold, said sensor operable to transduce the pressures presented to said inputs into said differential pressure signal representative of the pressure difference between said intake manifold and said exhaust manifold.

8. An electronic control unit as defined in claim 6 wherein said differential pressure means include:

a first pressure sensor having a pressure input communicating with the intake manifold pressure of the engine and operable to transduce that pressure into a first electrical signal representative of the absolute pressure of the intake manifold;

a second pressure sensor having a pressure input communicating with the exhaust manifold pressure of the engine and operable to transduce that pressure into a second electrical signal representative of the absolute pressure of the exhaust manifold; and means electrically connected to said first and second pressure sensors for calculating the difference between said first and second electrical signals to produce said differential pressure signal.

9. An electronic control unit as defined in claim 6 wherein said calculation means includes:

means for generating a pulse width signal in which the duration of the pulses is representative of the quantity of fuel to input to the engine.

10. An electronic control unit as defined in claim 8 wherein said difference calculating means includes:

a differential amplifier with its noninverting input electrically connected to receive said first electrical signal and its inverting input electrically connected to receive said second electrical signal.

11. An electronic control unit as defined in claim 6 wherein:

said correctional signal generating means generates the correction signal as a linear function of said differential pressure signal.

12. An electronic control unit as defined in claim 11 wherein said correctional signal generating means includes:

an operational amplifier and a PNP transistor, said operational amplifier having its noninverting input electrically connected to the differential pressure signal and its output electrically connected to the base terminal of said transistor, and wherein the emitter terminal of said transistor is electrically connected to a threshold voltage through a slope resistor and further connected to the inverting input of said amplifier, the collector terminal of said transistor forming the output for the generation of said correctional signal.

13. An electronic control unit as defined in claim 11 wherein:

said correctional signal is generated as a current which is a linear function of said differential pressure signal.

* * * * *